United States Patent [19]

Masao

[11] 4,425,840

[45] Jan. 17, 1984

[54] BLOWER

[75] Inventor: Morimoto Masao, Kasai, Japan

[73] Assignee: Sanyo Electric Co., Ltd., Moriguchi, Japan

[21] Appl. No.: 314,221

[22] Filed: Oct. 23, 1981

[30] Foreign Application Priority Data

Nov. 25, 1980 [JP] Japan ..... 55/166224

[51] Int. Cl.[3] ..... F24F 13/10; F04D 25/10

[52] U.S. Cl. ..... 98/40 V; 98/121 R; 417/423 R

[58] Field of Search ..... 98/40 V, 40 VM, 94, 98/120, 121; 415/121 G, 125; 417/423 R

[56] References Cited

U.S. PATENT DOCUMENTS 2,134,649 10/1938 Will et al. ..... 98/121 R X
2,824,429 2/1958 Zucker ..... 98/40 V X
3,481,534 12/1969 Price ..... 98/40 V X

*Primary Examiner*—Edward G. Favors
*Assistant Examiner*—Harold Joyce
*Attorney, Agent, or Firm*—Darby & Darby

[57] ABSTRACT

Herein disclosed is a blower which includes an axial flow fan, a body case defining a wind tunnel for the axial flow fan, a wind deflector mounted in the front opening of the wind tunnel for free rotations therein, and a guard mounted in the rear opening of the wind tunnel. The wind deflector can supply a soft comfortable wind over a wide angular range if it is rotated at a low speed.

4 Claims, 25 Drawing Figures

BLOWER

BACKGROUND OF THE INVENTION

1. Field of the Invention

The present invention relates to a blower and, more particularly, to a blower which can supply a soft comfortable wind over a wide angular range.

2. Description of the Prior Art

In one of the blowers known in the art, a wind deflector for supplying a wind over a wide range is placed in front of the axial flow type of fan and is rotated at a low speed.

In Japanese Utility Model Publication No. 35-8954; for instance, there is disclosed a blower of the type, in which a wind deflector is rotatably placed in front of an axial flow fan so that the swirling air flow generated by the axial flow fan may impinge upon the wind deflector to rotate the deflector. Since this deflector is rotated at a high speed if it were left as it is, an adjustable friction plate is provided to impart a suitable mechanical contact pressure to the wind deflector so that the r.p.m. of the deflector may be maintained at a low value.

In U.S. Pat. No. 3,481,534, moreover, there is disclosed a blower of the type, in which an air straightener is so fixed in front of an axial flow fan that the wind to be discharged is directed in parallel with the axis of rotation of the axial flow fan and in which a rotating deflector is rotatably placed in front of the air straightener. The blower thus disclosed can hardly be rotated under that condition, but the rotating deflector can be rotated at a low speed by making the inclination of one of the air straightening vanes adjustable.

However, the present invention is conceived to make a wind deflector rotatable at a low speed without resorting to the friction plate nor the air straightener which have been used in the prior art.

SUMMARY OF THE INVENTION

According to the present invention, there is provided a blower which comprises: an axial flow fan; means for driving said axial flow fan; a body case amounting therein said axial flow fan; a rotating wind deflector mounted in the front opening of said body case for free rotations therein; and a guard mounted on the rear opening of said body case, said rotating wind deflector including rotation changing vanes made receptive of the swirling air flow generated by said axial flow fan for imparting a rotational force in one direction to said rotating wind deflector, and brake changing vanes made receptive of said swirling air flow for imparting a rotational force in the opposite direction to said rotating wind deflector, whereby a wind can be supplied over a wide range while said rotating wind deflector being rotated in one direction at a low speed.

It is preferred that the r.p.m. of the rotating wind deflector of the present invention be about 5 to 30.

By the use of the special wind deflector of the present invention, a soft comfortable wind can be supplied over a wide angular range merely by imparting the swirling air flow generated by the axial flow fan to that wind deflector.

DESCRIPTION OF THE PREFERRED EMBODIMENTS

Figure 1:
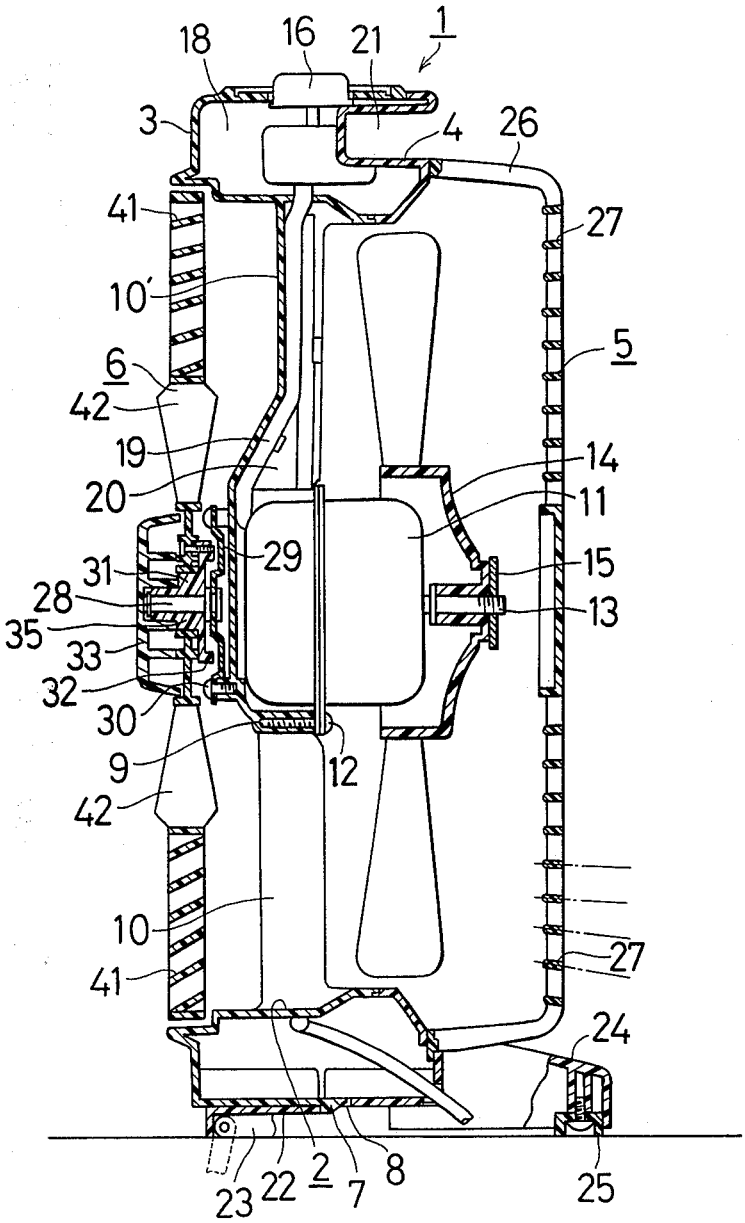
FIG. 1 is a sectional side elevation showing one embodiment of the blower according to the present invention.
Figure 2:
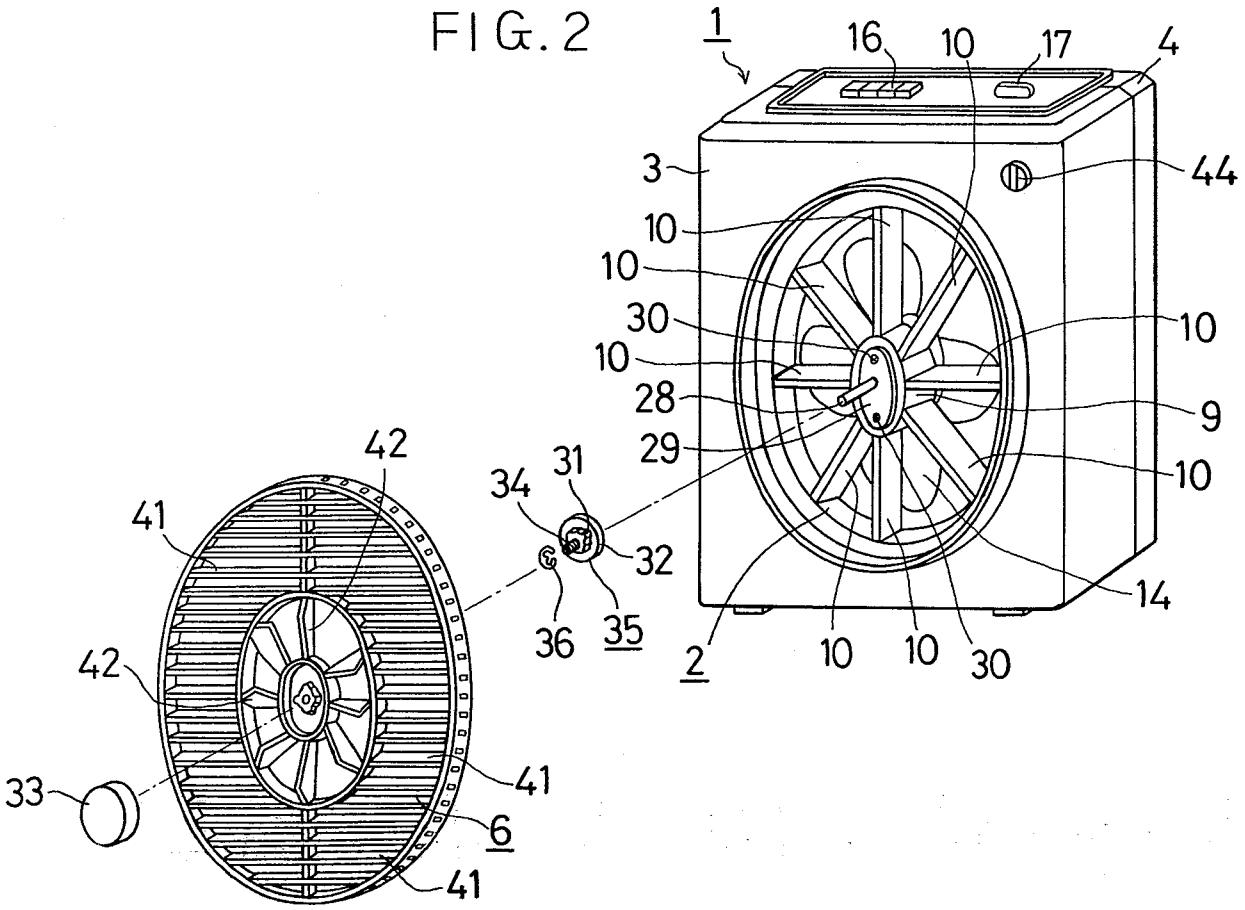
FIG. 2 is a perspective view showing the front of the blower with its rotating wind deflector being removed.
Figure 3:
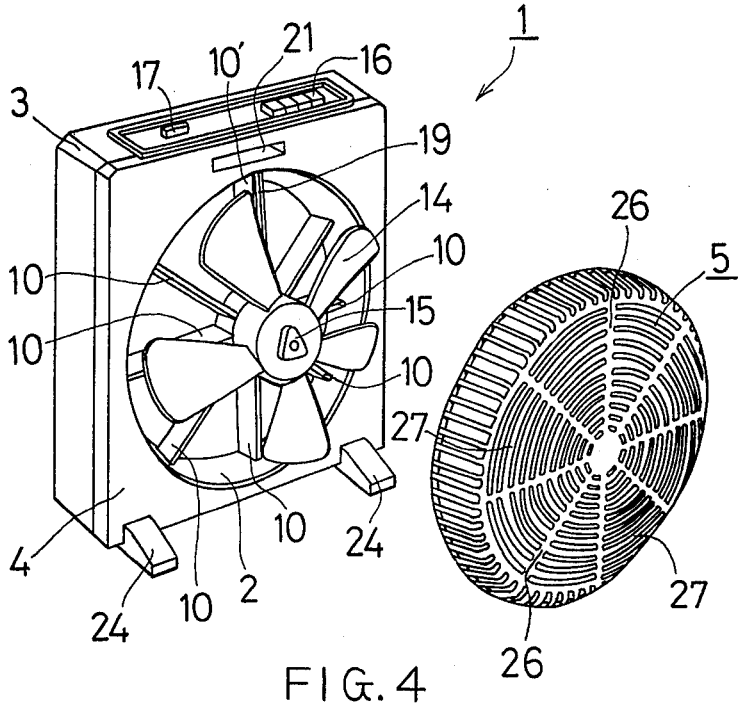
FIG. 3 is a perspective view showing the back of the blower with its guard being removed.

The present invention will now be described in connection with one embodiment thereof with reference to FIGS. 1 to 14.

Generally indicated at reference numeral 1 is a blower exemplifying the present invention, which is constructed of splittable front and rear case members 3 and 4 defining together a wind tunnel 2, a guard 5 removably mounted on the rear opening of the wind tunnel 2, and a rotating wind delector 6 rotatably mounted in the front opening of the wind tunnel 2.

Those front and rear case members 3 and 4 are so fixed, after they have been elastically jointed by means of an elastic rim 7 and a hole 8, by the use of not-shown screws that they may not be easily disassembled. The wind tunnel 2 in the front case member 3 is formed at its center with a motor mounting portion 9 which is partly supported in the wind tunnel by means of a plurality of supporting ribs 10 radially extending therefrom in the wind tunnel and partly formed integrally with the front case member 3. A motor 11 is secured to the back of the mounting portion 9 by means of screws 12. An axial flow fan 14 is so secured to the shaft 13 of the motor 11 by means of a nut 15 that it is positioned within the wind tunnel 2. The upper portion of the front case member 3 is formed with a space 18 for accommodating electric equipments such as a motor control switch 16 or a timer 17 (which are better seen in FIGS. 2 and 3), and the operating unit of the switch 16 and the timer 17 are formed to protrude from the upper top of the front case member. The upright supporting rib 10' extending upward from the motor mounting portion 9 is formed with a groove 20, in which a power supply cord 19 is mounted. The supporting ribs 10 other than that 10' formed with the groove 20 are formed into a plate shape so that they slightly straighten the swirling air flow generated by the axial flow fan 14.

The top of the rear case member 4 is formed at its back with a handle 21 and at its bottom with a receiving portion 22 which is extended to abut against the bottom of the front case member 3. Foldable legs 23 are hinged to both the sides of the bottom of the receiving portion 22. At both the sides of the bottom of the rear case member 4, there are provided a pair of supporting stands 24 which protrude in the opposite directions of the receiving portion 22, and elastic heels 25 are secured to the leading lower ends of the stands 24.

The aforementioned wind tunnel 2 is constructed by combining the front and rear case members 3 and 4, and the guard 5 is removably mounted in the rear opening of the wind tunnel of the rear case member 4 by its own elasticity or by means of clamping joints. The guard 5 thus mounted is constructed of a plurality of radial ribs 26 and a number of annular ribs 27, both of which are formed to have generally oval sections. The annular ribs 27 are so inclined that the longer axes of their oval sections are extended the more as they go outward from the center. As a result, the air to be sucked through the guard 5 into the fan 14 is allowed to pass therethrough smoothly with less resistance. To the front of the motor mounting portion 9, there is secured by means of screws 30 a mounting plate 29, on which a spindle 28 is mounted to protrude from the center thereof. That mounting plate 29 also acts as a plate for reinforcing the motor mounting portion 9. On the spindle 28, there is rotatably mounted an intermediate rotor 35, which is formed with a stem 31 to be fitted in the center hole of the rotating wind deflector 6, a flange 32 to abut against the back of the same deflector, and a threaded portion 34 to be fastened into a spinner 33 for clamping the aforementioned deflector 6 and the flange 32 inbetween (as better seen from FIG. 2). The intermediate rotor 35 is stopped and prevented from coming out by an E-ring 36 which is mounted on the leading end of the spindle 28. The friction resistance between this spindle 28 and the intermediate rotor 35 is so reduced by molding the spindle 28 of a metal rod and by molding the intermediate rotor 35 of an oil-impregnated resin that the rotations of the wind deflector 6 can be effected smoothly. On the contrary, a suitable friction resistance can be attained by selecting suitable materials of the spindle 28 and the intermediate rotor 35. In either event, the wind deflector 6 can be molded of a variety of such materials as take their strengths into consideration.

Figure 4:
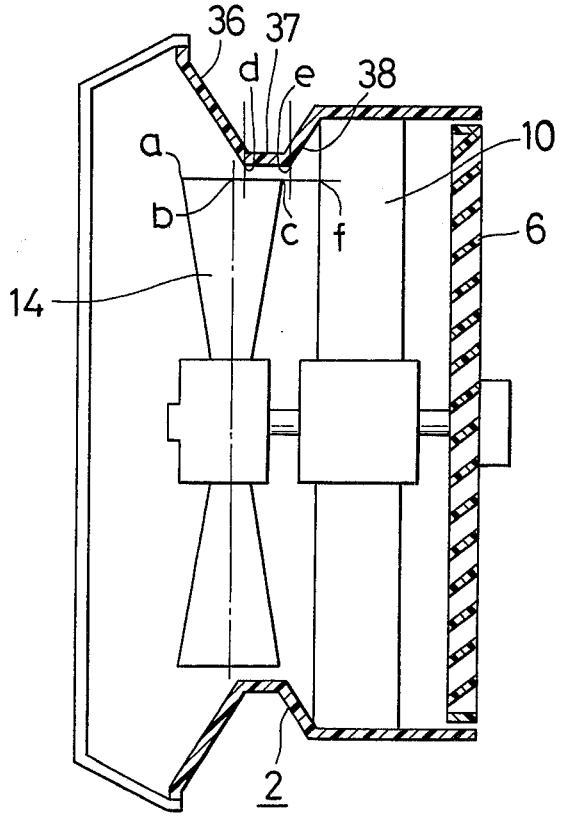
FIG. 4 is a schematic view showing the relationship between the body and the fan of the blower.

The positional relationship between the wind tunnel 2 and the axial flow fan 14 will now be described with reference to the explanatory schematic views and graphs of FIGS. 4 to 10. In FIG. 4, the rear and front edges of the axial flow fan 14 in the vicinity of the guard 5 are designated at points a and c, respectively, and the middle point between the points a and c, i.e., the center of the so-called "fan height" is designated at point b. The inner wall of the wind tunnel 2 is formed to have a generally trapezoidal section and to include a converging portion 36, which converges from the edge of the rear opening of the wind tunnel toward the point b, a cylindrical portion 37, which has a constant spacing from that fan between the points b and c, and a diverging portion 38 which diverges from the point c toward the front opening of the wind tunnel. The boundary edge between the cylindrical portion 37 and the converging portion 36 is designated at point d, and the boundary edge between the cylindrical portion 37 and the diverging portion 38 is designated at point e. Moreover, the rear edges of the aforementioned supporting ribs 10 formed in the wind tunnel 2 is designated at point f. In the front opening of the wind tunnel, there is mounted the rotating wind deflector 6 which changes the direction of the air flow coming from the fan 14. The supporting ribs 10 and wind deflector 6 thus constructed raise a high resistance to the coming air flow and a source of noises.

Since, in the conventional blower, the diverging portion 38 is not formed but the cylindrical portion 37 is elongated to directly face the wind deflector 6, the air is sucked along the converging portion 36, when the axial flow fan 14 performs its blowing operation, to impinge upon the supporting ribs 10 and the wind deflector 6 at the maximum velocity $V_1$. Hence, a resistance loss R is generally proportional to the square of the wind velocity V and is expressed by $R=KV^2$. As a result, according to the prior art, the resistance loss by the wind deflector is so high that the velocity of the wind to be blown out of the wind deflector is remarkably lowered and that the noises are increased. In the present embodiment, on the contrary, since the aforementioned diverging portion 38 is formed to extend from the front edge c of the fan 14 to the base end of the rear edge f of the supporting ribs 10, the wind velocity $V_1$ is decelerated at the diverging portion to $V_2$ so that the wind velocity at the supporting ribs 10 and the wind deflector 6 is decelerated. As a result, the aforementioned resistance loss R is so remarkably reduced that the velocity of the wind having passed through the deflector is accelerated with the noises being lowered.

Figure 5:
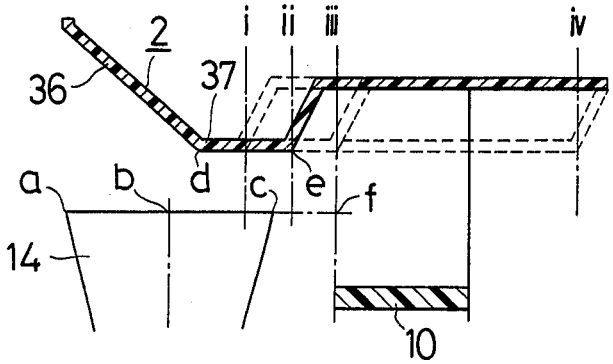
FIG. 5 is a schematic view showing the relationship among the wind tunnel, the fan and the supporting rib of the blower.
Figure 6:
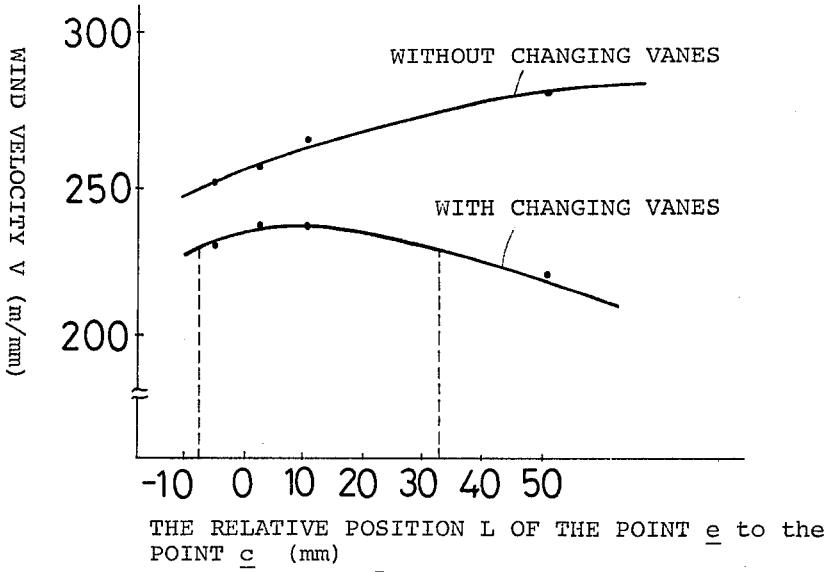
FIGS. 6 and 7 are graphs illustrating the characteristic curves of the relationships between the wind speed and noises and the distance of point e of FIG. 5.
Figure 7:
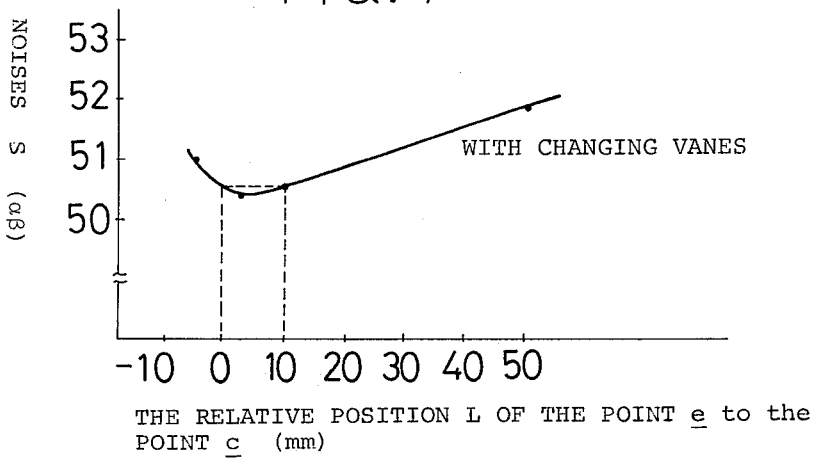
Figure 8:
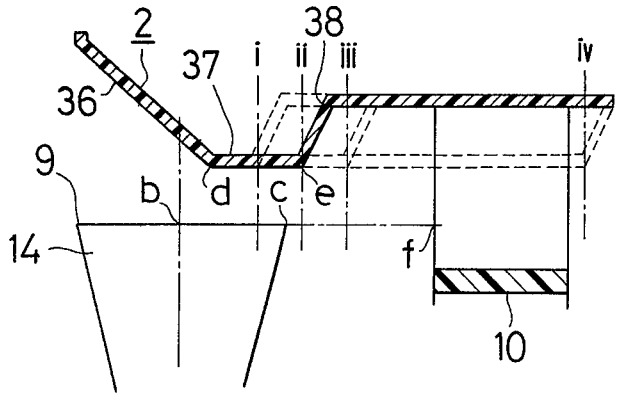
FIG. 8 is a schematic view showing the relationship among the wind tunnel, the fan and the supporting rib of the blower.
Figure 9:
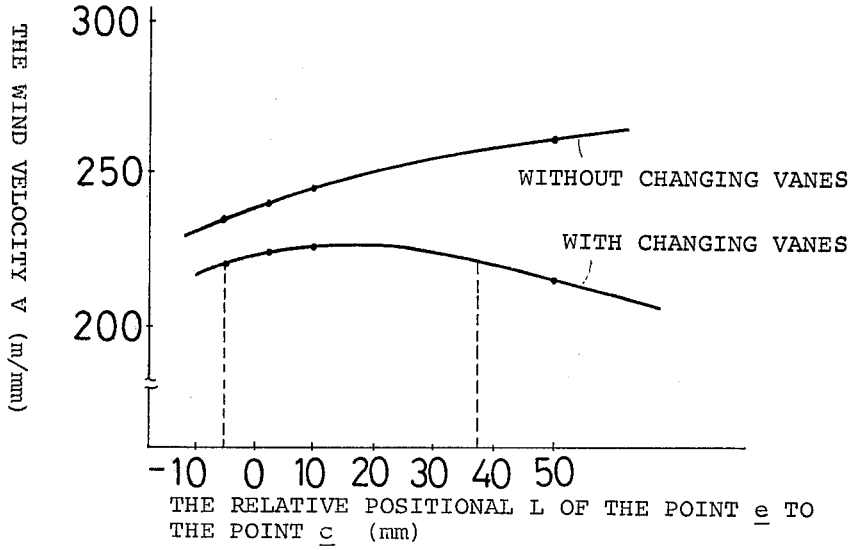
FIGS. 9 and 10 are graphs illustrating the characteristic curves of the relationships between the wind speed and noises and the distance of point e of FIG. 8.
Figure 10:
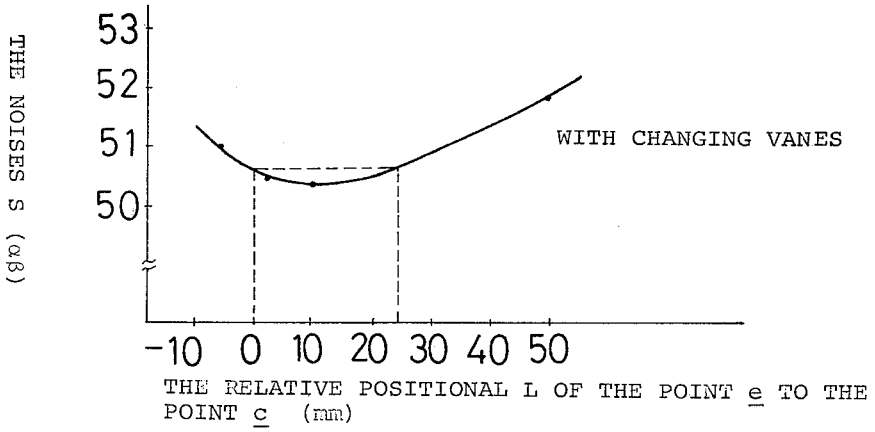

The following description will be made on the basis of the experimental results. As shown in FIG. 5: the point where the point e is placed 5 mm at the back of the point c is designated at Japanese Letter i; the point where the point e is placed 2.5 mm in front of the point c is designated at Japanese Letter ii; and the points where the point e is placed 10 mm and 50 mm, respectively, in front of the point c are designated at Japanese Letters iii and iv. Moreover, the width of the supporting ribs 10 is set at 22 mm, and the rear edge point f is placed 10 mm in front of the point c. Still moreover: the number of the blades of the axial flow fan 14 is eleven; the r.p.m. of the fan 14 is 1000; the number of the supporting ribs 10 is twenty; and the spacing between the point b and the cylindrical portion is 4 mm. With these settings, the relationships between the relative position L of the point e to the point c and the wind velocity V and the noises S are illustrated in FIGS. 6 and 7. From these Figures, for the wind velocity V the necessary velocity for the blowing operation can be ensured for the distance L of the point e of $-8<L<33$, and for the noises S a low noise level can be ensured for the distance L of the piont e of $0<L<10$. Hence, if the point e is located between the point c and the point f, the wind velocity V and the noise level S take proper levels. Other experimental results are illustrated in FIGS. 9 and 10, in which the rear edge point f of the supporting ribs 10 is placed 24 mm in front of the point c, as shown in FIG. 8. From these results, it can be found that excellent results for the wind velocity V and for the noise level S can be attained for the distance L of the point e within ranges of $-5<L<37$ and $0<L<24$, respectively. And, the proper wind velocity V and noise level S can be ensured if the point e is interposed between the points c and f similarly to the foregoing results.

Figure 11:
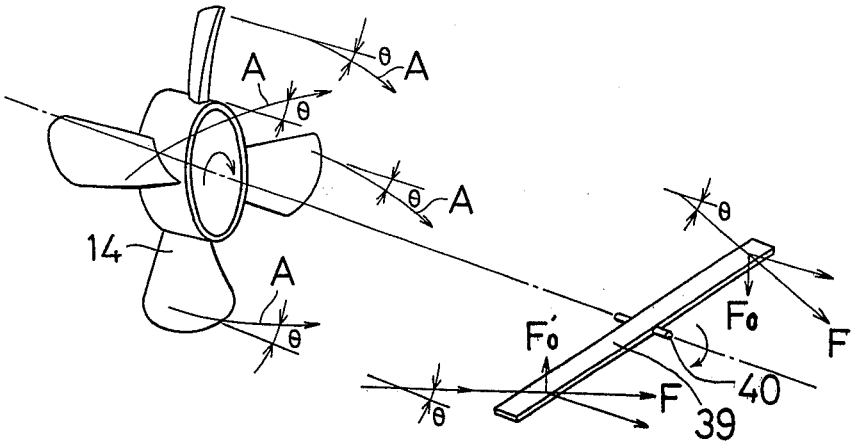
FIG. 11 is a perspective view showing the relationship between the axial flow fan and a deflecting vane.
Figure 12:
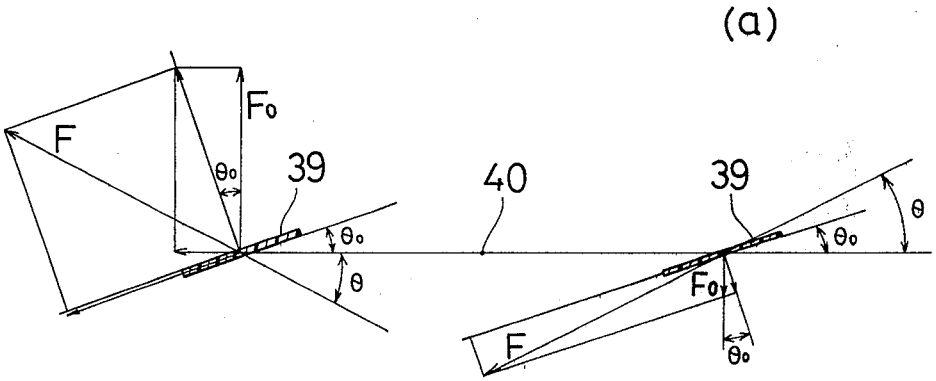
FIGS. 12(*a*) and (*b*) are diagrams showing the relationships between the deflecting vane and the air flow of FIG. 11.

The aforementioned wind deflector 6 is rotated by the wind pressure of the swirling air flow A which is generated by the axial flow fan 14. The rotating principles of the wind deflector 6 will be described with reference to FIGS. 11 and 12. As shown in FIG. 11, the blades of the axial flow fan 14 are twisted with a predetermined radius of curvature so that the air flow A generated by that fan is discharged in a direction twisted at an angle $\theta$. FIG. 12 explains the relationship of the force which is to be applied by the air flow to a number of wind deflecting vanes 39 of the wind deflector 6 positioned in front of the fan 14 when the vane 39 has its longitudinal direction arranged horizontally. The righthand and lefthand halves of the wind deflecting vane 39 are shown in FIGS. 12(*a*) and 12(*b*), respectively. As shown, the force Fo to move the vane in the direction of the plane of rotation is expressed by $Fo=F \sin(\theta-\theta o)\cos\theta o$, if the angle of inclination of the vane 39 is designated at $\theta o$, if the force of the air flow A is designated at F, and if the blown angle of the air flow A is designated at $\theta$. Now, if the right and left have an identical inclination, as shown in FIG. 12, and if the relationship of $\theta>\theta o$ holds, a downward force is exerted at the righthand half, whereas an upward force is exerted at the lefthand half. As a result, clockwise moments on a pivot 40 are exerted upon the wind deflecting vane 39 so that this vane 39 is rotated clockwise. For $\theta=\theta o$, the relationship of $Fo=0$ holds at the righthand half so that the clockwise moment is exerted only upon the lefthand half. For $\theta<\theta o$, the counter-clockwise moment is exerted at the righthand half, whereas the clockwise moment is exerted at the lefthand half. As a result, the wind deflecting vane 39 is rotated clockwise by the difference between the two moments. Although the explanations using FIG. 12 are made by the use of a positive angle at which $\theta$ is measured counter-clockwise, if $\theta o$ is taken clockwise and inclined in the negative direction and if $|\theta|<|-\theta o|$, the clockwise moment is exerted at the righthand half, whereas the counter-clockwise moment is exerted at the lefthand half. As a result, the wind deflecting vane 39 is rotated clockwise by the difference of the two moments thus far described. For $\theta<\theta o$ at the righthand half and $|\theta|<|-\theta o|$ at the lefthand half, on the contrary, the counter-clockwise moment is exerted at the righthand half, and the counter-clockwise moment is exerted at the lefthand half, too. As a result, the vane 39 is rotated counter-clockwise.

Figure 14:
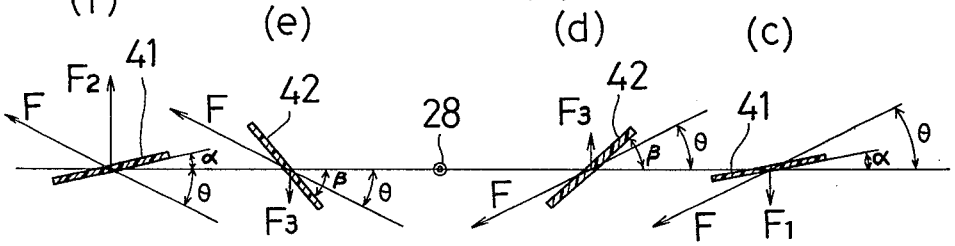
FIGS. 14(*c*), (*d*), (*e*) and (*f*) are sections taken along lines c—c, d—d, e—e and f—f, respectively, of FIG. 13.
Figure 15:
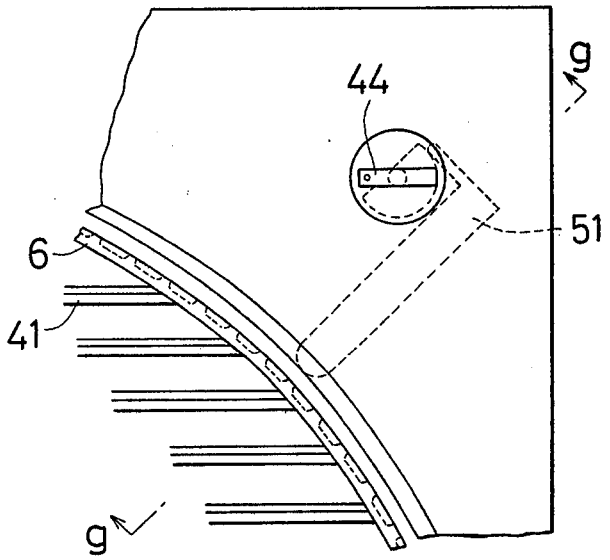
FIG. 15 is a front elevation showing the construction of a portion around an operating knob of FIG. 13.
Figure 16:
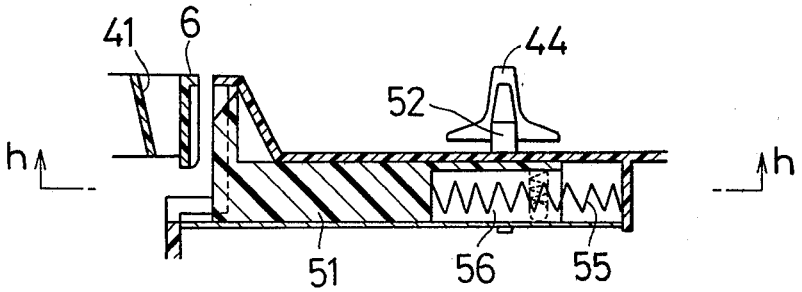
FIG. 16 is a section taken along line g—g of FIG. 15.
Figure 17:
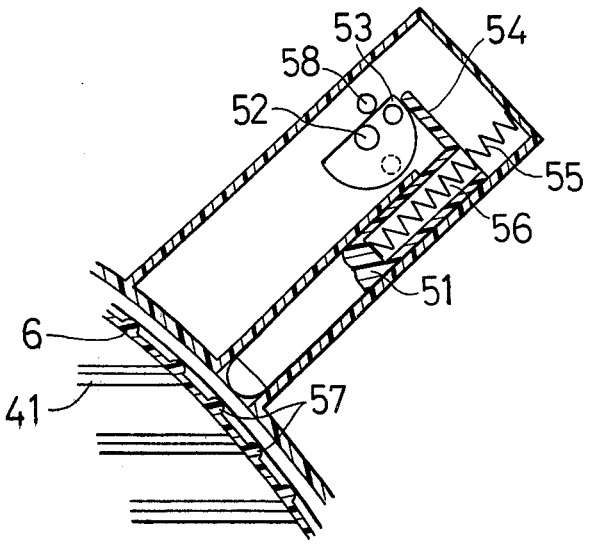
FIG. 17 is a section taken along line h—h of FIG. 16.

In the present embodiment, the aforementioned wind deflector 6 has its outer circumferential portion formed with a number of wind deflecting vanes 41, which are juxtaposed at the aforementioned angle $\theta>\theta o=\alpha$, and its inner circumferential portion formed with a number of wind deflecting vanes 42 which are radially arranged at the aforementioned angle $\theta<\theta o=\beta$. Thus, at the lefthand half, the wind deflecting vanes 42 are formed at the aforementioned angle of $|\theta|<|-\theta o|=|-\beta|$. The rotations of the wind deflector 6 having the construction thus far described will now be described with reference to FIG. 14. FIGS. 14(*c*), (*d*), (*e*) and (*f*) show the sections taken along lines c—c. d—d, e—e and f—f, respectively, about the spindle 28. As shown in FIGS. 14(*c*) and (*f*), clockwise moments F1 and F2 are exerted so that the wind deflector 6 is to be rotated clockwise by the composed force P of the forces F1+F2. As shown in FIGS. 14(*d*) and (*e*), on the contrary, a counter-clockwise moment F3 is exerted so that the composed force Q of 2F3 will rotate the wind deflector 6 in the counter-clockwise direction. Because of $P<Q$, the wind deflector 6 is rotated clockwise slowly at a low speed so that it can supply a soft comfortable wind over a wide angular range. Needless to say, the aforementioned counter-clockwise moment Q acts as a braking force so that the vanes 41 formed in the outer circumferential portion act as rotation changing vanes whereas the vanes 42 formed in the inner circumferential portion act as brake changing vanes. However, if the ratio of the vanes 42 in the inner circumferential portion to the wind deflector 6 is so increased that the force relationship of the aforementioned two moments becomes $P<Q$, the vanes 41 act as the brake changing vanes whereas the vanes 42 act as the rotation changing vanes. Since the two moments P and Q are varied in proportion to the r.p.m. of the aforementioned fan 14 and accordingly to the force F of the air flow, the rotational velocity of the wind deflector 6 is not highly changed even with the increase or decrease in the r.p.m. of the fan 14. Since the vanes 42 are radially formed in the inner circumferential portion of the deflector 6, the swirling air flow A generated by the fan 14 is more or less arranged into a forward straight wind having an increased velocity.

Figure 13:
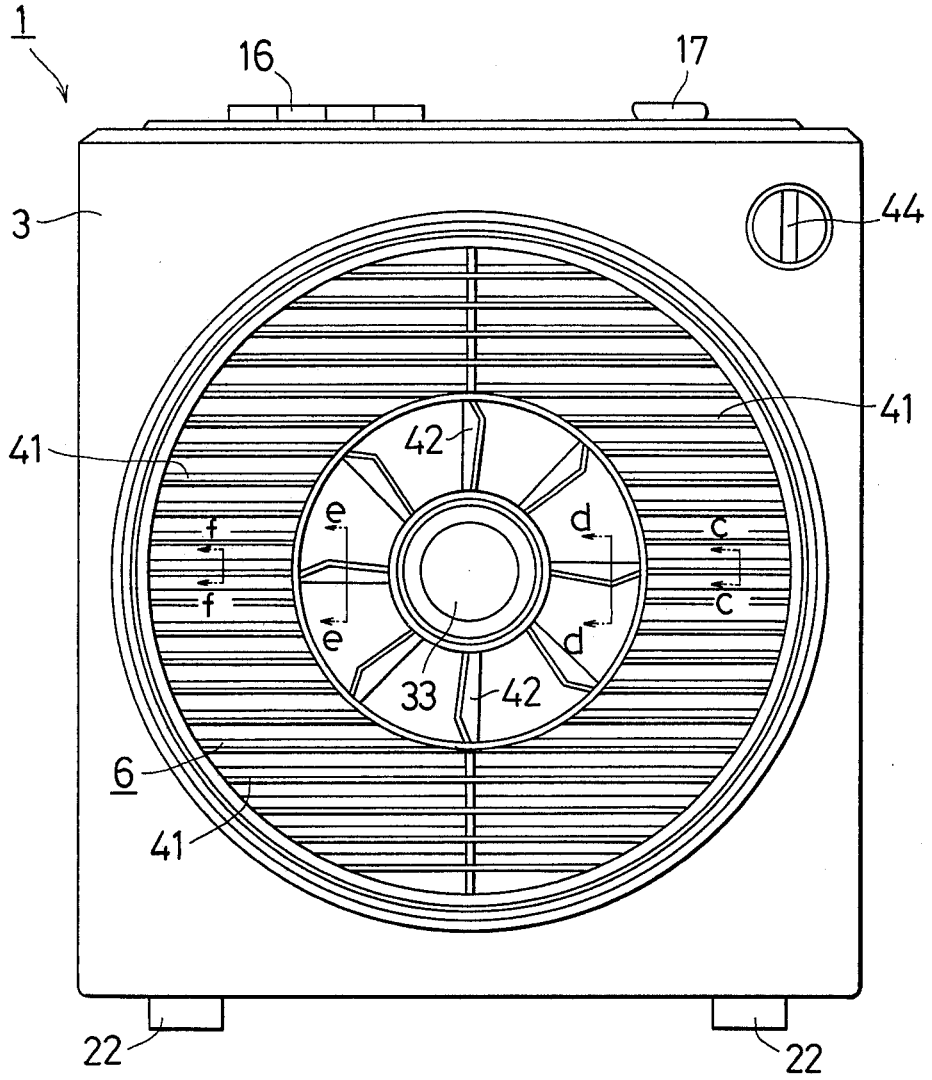
FIG. 13 is a front elevation showing the blower.

Incidentally, although the vanes 42 of FIG. 13 are arranged in the radial direction, they can be made to act as the brake changing vanes even if they are arranged in parallel.

Figure 18:
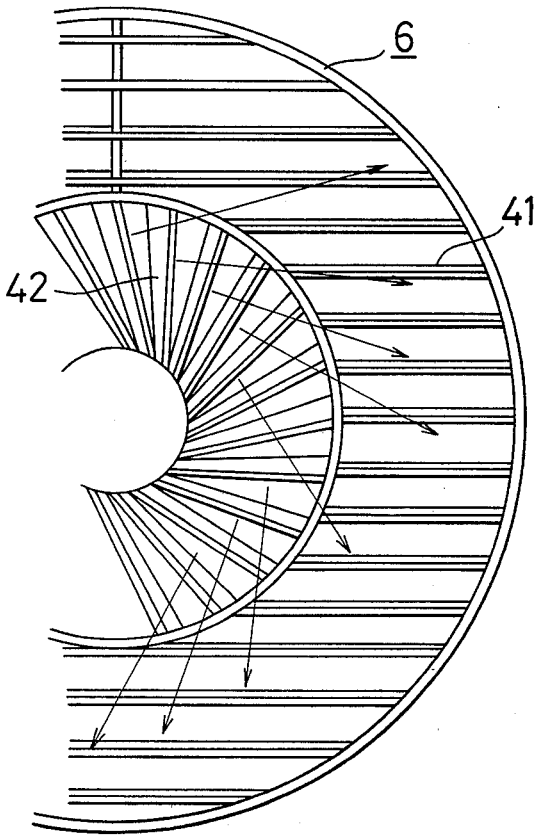
FIGS. 18, 19, 20 and 21 are front elevations showing other embodiments of the rotating wind deflector.
Figure 19:
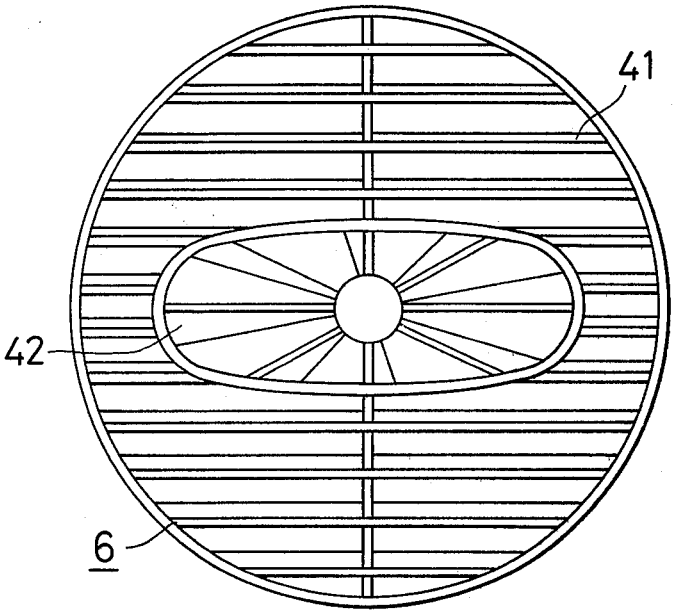
Figure 20:
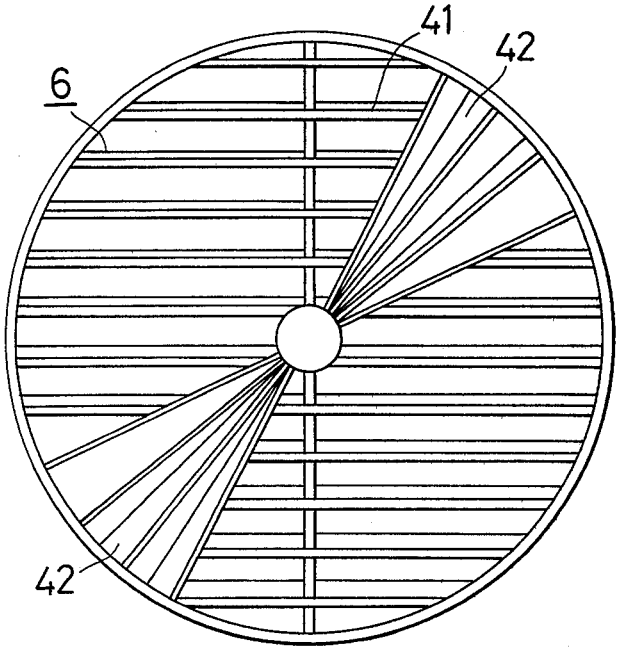
Figure 21:
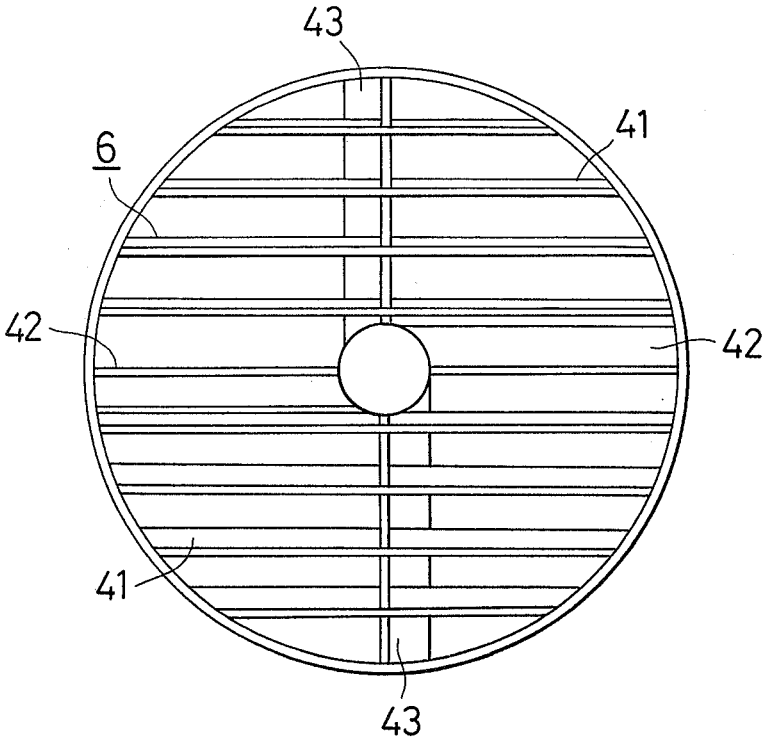

As shown in FIG. 18, since the brake changing vanes 42 arranged radially in the aforementioned first embodiment are made to have their center base ends slightly advancing clockwise from their radially outer terminal ends, there can be developed a wind which diverges, as shown by arrows. On the other hand, as shown in FIG. 19, the brake changing vanes 42 arranged radially are made to have their radially outer terminal ends drawing an oval. As shown in FIG. 20, moreover, the brake changing vanes 42 are arranged radially outwardly from the center of the aforementioned wind deflector 6. As shown in FIG. 21, on the other hand, a modified flow of the air flow changed by the rotation changing vanes 41 can be established by using both the warp preventing ribs 43 of the deflector 6 and the wind deflecting vanes 42 at right angles as the brake changing vanes so that a wind similar to a natural one can be blown.

Although, in the embodiments thus far described, the numerous wind deflecting vanes 42 are arranged in parallel at the angle $\theta>\theta o=\alpha$ at the outer circumferential portion thereby to provide the rotation changing vanes whereas the numerous wind changing vanes 42 are radially arranged at the angle $\theta<\theta o=\beta$ thereby to provide the brake chaning vanes, the present invention should not be especially limited thereto but can be modified into a variety of modes by suitably changing both the swirling angle $\theta$ of the air flow A and the angle $\theta o$ of inclination of the wind deflecting vanes on the basis of the rotating principles of the aforementioned wind deflector. For example, if the wind deflecting vanes formed in the outer circumferential portion of the foregoing embodiments are also arranged at the same angle of $\theta<\theta o=\beta$ as the wind deflecting vanes formed in the inner circumferential portion, not only the wind deflecting vanes in the inner circumferential portion act as the brake chaning vanes, but also the righthand half of the wind deflecting vanes in the outer circumferential portion also act as the brake changing vanes whereas the lefthand half of the wind deflecting vanes in the outer circumferential portion acts as the rotation changing vanes. As a result, the wind deflector can be rotated at a lower speed than the foregoing embodiments, and the inclination of the wind deflecting vanes can be made larger so that the wind can be blown over a wider range. On the other hand, the case of $\theta < \theta o$ explained in the rotating principles of the wind deflector 6 is applied so that the wind deflecting vanes are inclined at a larger angle than the angle $\theta$ of the swirling air flow and are arranged in parallel. Then, the wind deflector has its righthand half acting as the brake changing vanes and its lefthand half acting as the rotation changing vanes. Moreover, the wind deflector 6 is not inclined at the same angle from its right to left end but can be inclined at different angles at the righthand and lefthand halves. Still moreover, the angles of the respective wind deflecting vanes may be gradually varied. In this particular modification, the brake changing vanes and the rotation changing vanes are not grouped but are arranged under mixed conditions.

The rotations and interruptions of the wind deflector 6 in the respective embodiments thus far described can be performed by bringing the leading end of a stopper lever 51, which is moved back and forth by the cam 53 to be rotated by an operating knob 44 disposed in the front case member 3, as shown in FIGS. 15 to 18, into and out of abutment contact with the outer circumference of the wind deflector 6. On the other hand, the rotations and interruptions of the wind deflector 6 can also be performed by making the deflector 6 movable back and forth as a whole so that it may engage either the opening of the wind tunnel of the front case member 3 or the projection formed in the mounting plate when it is moved back and forth. Incidentally, these rotating and interrupting mechanisms need not be restricted to the aforementioned ones but can have a variety of constructional modifications.

As has been described hereinbefore, according to the present invention, since the wind deflector to be rotated by the wind pressure of the swirling air flow generated by the axial flow fan is constructed of the rotation changing vanes, to which a rotational force in a positive direction is imparted by that wind pressure, and the brake changing vanes to which a rotational force in the opposite direction is imparted by that wind pressure, the wind deflector to be rotated at a high speed in synchronism with that wind pressure need not be equipped with a separate brake device thereby to enjoy various effects that the number of parts inclusive can be reduced, that the construction can be simplified, and that the braking force can be changed in proportion to the change in the wind pressure so that the wind direction can be stably changed.

Incidentally, the present invention should not be limited to the box type blower presented merely for exemplification, but can be applied not only to a window ventilation fan, which is attached to a window for practical uses, but also to various blowers for effecting the wind blowing operations by the use of the axial flow fan, such as, an air conditioner or a humidifier.

What is claimed is:

1. A blower comprising:

a body case having at least a front opening;

an axial flow fan mounted in said body case;

means coupled to said axial flow fan for driving said axial flow fan;

a generally circular rotating deflector means having a center, mounted in said front opening of said body case for a free rotation therein, wherein said rotating deflector means comprises:

brake changing vanes arranged radially about said center of said deflector and disposed in a substantially circular area concentric with said center of said deflector, said brake changing vanes being responsive to a swirling air flow from said axial flow fan for imparting a braking force in a braking direction to said deflector; and rotation changing vanes arranged in parallel and disposed in a ring concentric with and circumferential to said brake changing vanes, said rotation changing vanes being responsive to said swirling air flow generated by said axial flow fan for imparting force to said deflector in a rotational direction, said rotational direction being opposite to said braking direction, whereby an airflow is directed over a wide angular range by said blower, said deflector being rotated in said rotation direction at a low speed.

2. A blower according to claim 1, wherein the r.p.m. of said deflector is about 5 to 30.

3. A blower according to claim 1, wherein said brake changing vanes have their center base ends advancing in the clockwise direction from their radially outer terminal ends.

4. A blower according to claim 1, wherein said brake changing vanes are arranged in a center oval whereas said rotation changing vanes are arranged in an outer circumference around said center oval.

* * * * *